US007021282B1

(12) United States Patent
Livshiz et al.

(10) Patent No.: US 7,021,282 B1
(45) Date of Patent: Apr. 4, 2006

(54) COORDINATED ENGINE TORQUE CONTROL

(75) Inventors: Michael Livshiz, Ann Arbor, MI (US); Scott J. Chynoweth, Fenton, MI (US); Jeffrey M. Kaiser, Highland, MI (US); Richard H. Clutz, Howell, MI (US); Donovan L. Dibble, Utica, MI (US); Bahram Younessi, Farmington, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 11/001,708

(22) Filed: Dec. 1, 2004

(51) Int. Cl.
*F02D 13/00* (2006.01)

(52) U.S. Cl. ..... 123/347; 123/348; 123/350

(58) Field of Classification Search ..... 123/347, 123/345, 346, 348, 350, 399, 361, 90.15, 123/90.16, 90.17; 73/118.2; 701/103, 104, 701/105

See application file for complete search history.

(56) References Cited

U.S. PATENT DOCUMENTS

| | | | | |
|---|---|---|---|---|
| 5,921,219 | A * | 7/1999 | Frohlich et al. | 123/399 |
| 6,308,671 | B1 * | 10/2001 | Reed et al. | 123/90.15 |
| 6,704,638 | B1 | 3/2004 | Livshiz et al. | 701/102 |
| 6,761,146 | B1 * | 7/2004 | Livshiz et al. | 123/361 |
| 2005/0056251 | A1 * | 3/2005 | Stroh et al. | 123/350 |

* cited by examiner

*Primary Examiner*—Andrew M. Dolinar
*Assistant Examiner*—Johnny H. Hoang
(74) *Attorney, Agent, or Firm*—Christopher DeVries

(57) ABSTRACT

A torque control system for regulating operation of an engine includes a throttle that regulates air flow into the engine and a device that regulates a torque output of the engine. A first module determines a throttle area based on a desired manifold absolute pressure (MAP) and a desired manifold air flow (MAF) and a second module determines a device set-point based on a desired air per cylinder (APC) and an engine speed. A third module generates a throttle control signal to control the throttle based on the throttle area and generates a device control signal to control the device based on the device set-point.

48 Claims, 4 Drawing Sheets

COORDINATED ENGINE TORQUE CONTROL

FIELD OF THE INVENTION

The present invention relates to engines, and more particularly to coordinated torque control of an engine.

BACKGROUND OF THE INVENTION

Internal combustion engines combust an air and fuel mixture within cylinders to drive pistons, which produces drive torque. Air flow into the engine is regulated via a throttle. More specifically, the throttle adjusts throttle area, which increases or decreases air flow into the engine. As the throttle area increases, the air flow into the engine increases. A fuel control system adjusts the rate that fuel is injected to provide a desired air/fuel mixture to the cylinders. As can be appreciated, increasing the air and fuel to the cylinders increases the torque output of the engine.

Engine control systems have been developed to accurately control engine torque output to achieve a desired torque. Traditional engine control systems, however, do not control the engine torque output as accurately as desired. Further, traditional engine control systems do not provide as rapid of a response to control signals as is desired or coordinate engine torque control among various devices that affect engine torque output.

SUMMARY OF THE INVENTION

Accordingly, the present invention provides a torque control system for regulating operation of an engine. The torque control system includes a throttle that regulates air flow into the engine and a device that regulates a torque output of the engine. A first module determines a throttle area based on a desired manifold absolute pressure (MAP) and a desired manifold air flow (MAF) and a second module determines a device set-point based on a desired air per cylinder (APC) and an engine speed. A third module generates a throttle control signal to control the throttle based on the throttle area and generates a device control signal to control the device based on the device set-point.

In other features, the device includes a cam phaser that regulates a phase angle of a cam shaft relative to a rotational position of the engine. The cam shaft includes an intake cam shaft. The cam shaft includes an exhaust cam shaft.

In another feature, the device includes an exhaust gas recirculation (EGR) valve that regulates a flow of exhaust gas into an intake manifold of the engine.

In another feature, the device includes an intake manifold valve that selectively partitions a volume of the intake manifold.

In another feature, the device includes a turbo that provides compressed air to the engine.

In another feature, the torque control system further includes a fourth module that determines the desired MAP based on the engine speed and a torque request.

In another feature, the torque control system further includes a fourth module that determines the desired MAF based on the desired APC.

In still another feature, the torque control system further includes a fourth module that determines the desired APC based on the torque request and a device schedule feedback signal.

In yet other features, the desired APC is corrected based on an APC correction factor. The APC correction factor is determined based on a torque request and a torque estimate.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

Figure 1:
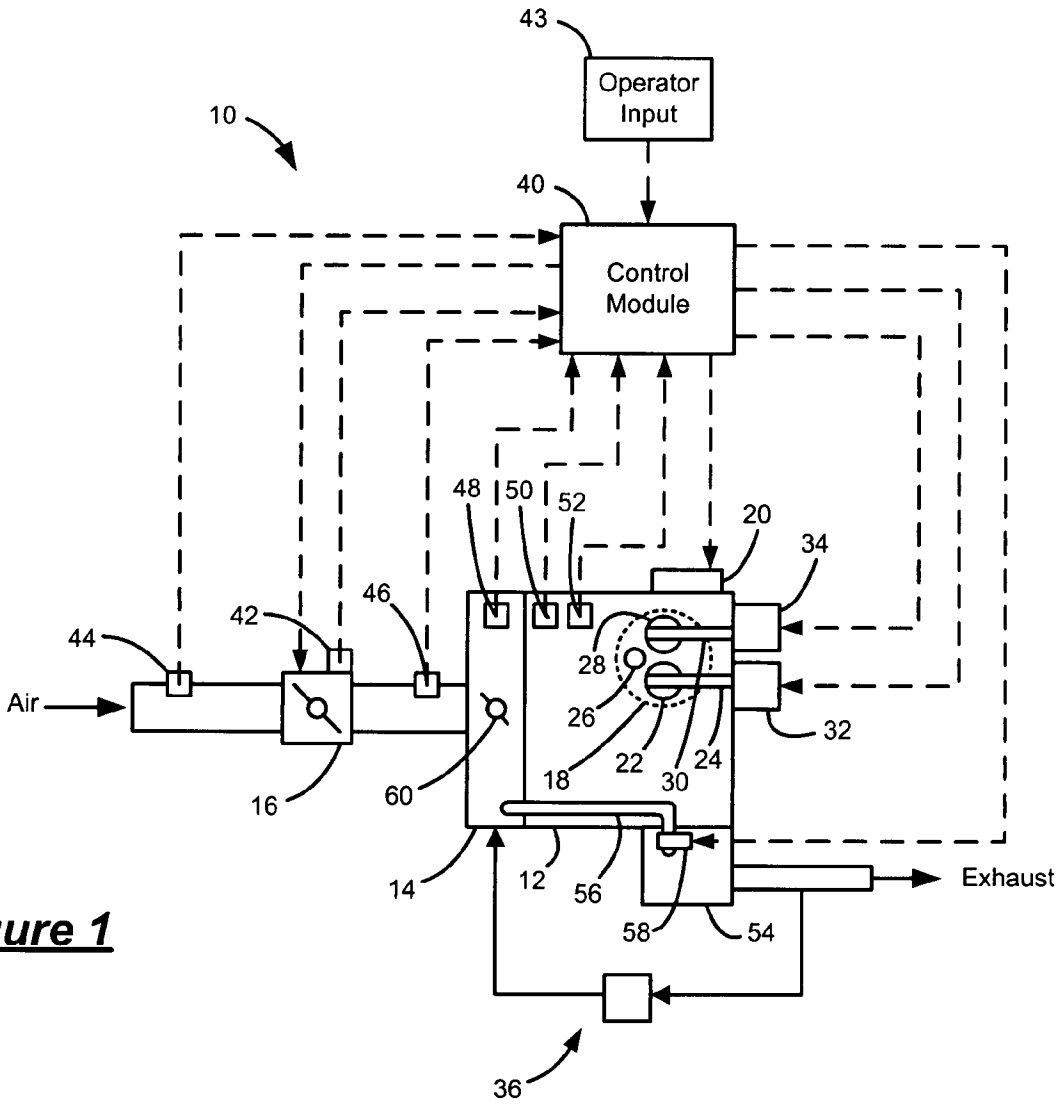
FIG. 1 is a schematic illustration of an exemplary engine system according to the present invention.

The following description of the preferred embodiment is merely exemplary in nature and is in no way intended to limit the invention, its application, or uses. For purposes of clarity, the same reference numbers will be used in the drawings to identify similar elements. As used herein, the term module refers to an application specific integrated circuit (ASIC), an electronic circuit, a processor (shared, dedicated, or group) and memory that execute one or more software or firmware programs, a combinational logic circuit, or other suitable components that provide the described functionality.

Referring now to FIG. 1, an engine system 10 includes an engine 12 that combusts an air and fuel mixture to produce drive torque. Air is drawn into an intake manifold 14 through a throttle 16. The throttle 16 regulates mass air flow into the intake manifold 14. Air within the intake manifold 14 is distributed into cylinders 18. Although a single cylinder 18 is illustrated, it can be appreciated that the coordinated torque control system of the present invention can be implemented in engines having a plurality of cylinders including, but not limited to, 2, 3, 4, 5, 6, 8, 10 and 12 cylinders.

A fuel injector (not shown) injects fuel that is combined with the air as it is drawn into the cylinder 18 through an intake port. The fuel injector may be an injector associated with an electronic or mechanical fuel injection system 20, a jet or port of a carburetor or another system for mixing fuel with intake air. The fuel injector is controlled to provide a desired air-to-fuel (A/F) ratio within each cylinder 18.

An intake valve 22 selectively opens and closes to enable the air/fuel mixture to enter the cylinder 18. The intake valve position is regulated by an intake cam shaft 24. A piston (not shown) compresses the air/fuel mixture within the cylinder 18. A spark plug 26 initiates combustion of the air/fuel mixture, which drives the piston in the cylinder 18. The piston, in turn, drives a crankshaft (not shown) to produce drive torque. Combustion exhaust within the cylinder 18 is forced out an exhaust port when an exhaust valve 28 is in an open position. The exhaust valve position is regulated by an exhaust cam shaft 30. The exhaust is treated in an exhaust system and is released to atmosphere. Although single intake and exhaust valves 22,28 are illustrated, it can be appreciated that the engine 12 can include multiple intake and exhaust valves 22,28 per cylinder 18.

The engine system 10 can include an intake cam phaser 32 and an exhaust cam phaser 34 that respectively regulate the rotational timing of the intake and exhaust cam shafts 24,30. More specifically, the timing or phase angle of the respective intake and exhaust cam shafts 24,30 can be retarded or advanced with respect to each other or with respect to a location of the piston within the cylinder 18 or crankshaft position. In this manner, the position of the intake and exhaust valves 22,28 can be regulated with respect to each other or with respect to a location of the piston within the cylinder 18. By regulating the position of the intake valve 22 and the exhaust valve 28, the quantity of air/fuel mixture ingested into the cylinder 18 and therefore the engine torque is regulated.

The engine system 10 can also include an exhaust gas recirculation (EGR) system 36. The EGR system 36 includes an EGR valve 38 that regulates exhaust flow back into the intake manifold 14. The EGR system is generally implemented to regulate emissions. However, the mass of exhaust air that is recirculated back into the intake manifold 14 also affects engine torque output.

A control module 40 operates the engine based on the coordinated torque control approach of the present invention. More specifically, the control module 40 generates a throttle control signal based on an engine torque request ($T_{REQ}$) and a throttle position signal generated by a throttle position sensor (TPS) 42. $T_{REQ}$ is generated based on an operator input 43 such as an accelerator pedal position. The control module 40 commands the throttle 16 to a steady-state position to achieve an effective throttle area ($A_{THR}$). A throttle actuator (not shown) adjusts the throttle position based on the throttle control signal. The throttle actuator can include a motor or a stepper motor, which provides limited and/or coarse control of the throttle position. The control module 40 also regulates the fuel injection system 20, the cam shaft phasers 32,34 and the EGR system 36 to achieve $T_{REQ}$.

An intake air temperature (IAT) sensor 44 is responsive to a temperature of the intake air flow and generates an intake air temperature signal. A mass airflow (MAF) sensor 46 is responsive to the mass of the intake air flow and generates a MAF signal. A manifold absolute pressure (MAP) sensor 48 is responsive to the pressure within the intake manifold 14 and generates a MAP signal. An engine coolant temperature sensor 50 is responsive to a coolant temperature and generates an engine temperature signal. An engine speed sensor 52 is responsive to a rotational speed (i.e., RPM) of the engine 12 and generates in an engine speed signal. Each of the signals generated by the sensors are received by the control module 40.

The engine system 10 can also include a turbo or supercharger 54 that is driven by the engine 12 or engine exhaust. The turbo 54 compresses air drawn in from the intake manifold 14. More particularly, air is drawn into an intermediate chamber of the turbo 54. The air in the intermediate chamber is drawn into a compressor (not shown) and is compressed therein. The compressed air flows back to the intake manifold 14 through a conduit 56 for combustion in the cylinders 18. A bypass valve 58 is disposed within the conduit 56 and regulates the flow of compressed air back into the intake manifold 14.

The intake manifold 14 can be a multi-plenum, active intake manifold (AIM). The intake manifold 14 can be of a discrete position type or of a continuously variable type. Discrete position type intake manifolds include multi-plenums divided by a tuning valve 60 or short/long runner designs with shut-off valves. Continuously variable type intake manifolds include variable runner length designs. Although FIG. 1 illustrates a discrete position type intake manifold, it is anticipated that the engine control of the present invention can also be implemented in a continuously variable type AIM. A resonance geometric configuration of the intake manifold 14 is adjusted based on operational categories of the engine 10, as discussed in further detail in commonly assigned U.S. pat. app. Ser. No. 10/763,518, filed on Jan. 23, 2004, the disclosure of which is expressly incorporated herein by reference. The resonance geometric configurations include a tuned configuration and a detuned configuration.

The intake manifold tuning valve 60 selectively divides the intake manifold into first and second plenums (not shown). When the tuning valve 60 is in an open position, fluid communication is enabled across the entire intake manifold 14 and the intake manifold 14 is in a detuned state. When the tuning valve 60 is in a closed position, the intake manifold 14 is split into the first and second plenums fluid communication is inhibited between the first and second plenums and the intake manifold 14 is in a tuned state. In the tuned state, the volumetric efficiency ($V_{EFF}$) is higher than that of the detuned state for the same MAP. As a result, more air and fuel are added and retained in the cylinder 20 in the tuned state than in the detuned state. Therefore, intake manifold tuning is an effective means to improve the power density of the engine 10 at full load conditions. The control module 40 can also regulate the tuning valve 60 to achieve $T_{REQ}$.

The coordinated torque control system of the present invention regulates engine torque output based on $A_{THR}$ and one or multiple device set-points ($D_X$) based on the devices implemented with the engine 12. Exemplary devices include, but are not limited to, the intake cam phaser 32, the exhaust cam phaser 34, the EGR system 36, the turbo 54 and the intake manifold tuning valve 60. The device set-points include, but are not limited to, an intake phaser set-point ($D_{IPHSR}$), an exhaust phaser set-point ($D_{EPHSR}$), an EGR set-point ($D_{EGR}$), a bypass valve set-point ($D_{BPV}$) and an intake manifold tuning valve set-point ($D_{IMTV}$). The throttle 16 is regulated based on $A_{THR}$ and one or more of the devices are regulated based on their respective device set-points (i.e., $D_{IPHSR}$, $D_{EPHSR}$, $D_{EGR}$, $D_{BPV}$ and $D_{IMTV}$) to achieve $T_{REQ}$.

$A_{THR}$ is determined based on a desired manifold air flow ($MAF_{DES}$) and a desired manifold absolute pressure ($MAP_{DES}$). $MAF_{DES}$ is determined based on a desired air-per-cylinder ($APC_{DES}$) and is characterized by the following relationships:

$$APC_{DES}=T_{APC}^{-1}(T_{REQ}, S, I, E, AF, OT, N); \text{ and}$$

$$MAF_{DES} = \frac{APC_{DES} \cdot R}{k_{CYL}}$$

where: S is the ignition spark timing;

I is the intake cam phase angle;

E is the exhaust cam phase angle;

AF is the air/fuel ratio;

OT is the oil temperature; and

N is the number of cylinders.

$MAP_{DES}$ is determined based on RPM and $T_{REQ}$ and is characterized by the following equation:

$$MAP_{DES}=T_{MAP}^{-1}((T_{REQ}+f(\Delta T)), S, I, E, AF, OT, N)$$

where ΔT is the difference between first and second torque estimations. The calculation of $MAF_{DES}$, $APC_{DES}$ and $MAP_{DES}$ is discussed in further detail in commonly assigned U.S. patent application Ser. No. 10/664,172, filed Sep. 17, 2003, the disclosure of which is expressly incorporated herein by reference. The device set-point ($D_X$) is determined based on engine speed and $APC_{DES}$. In general, $D_X$ can determined from a look-up table or can be calculated based on engine speed and $APC_{DES}$.

Figure 2:
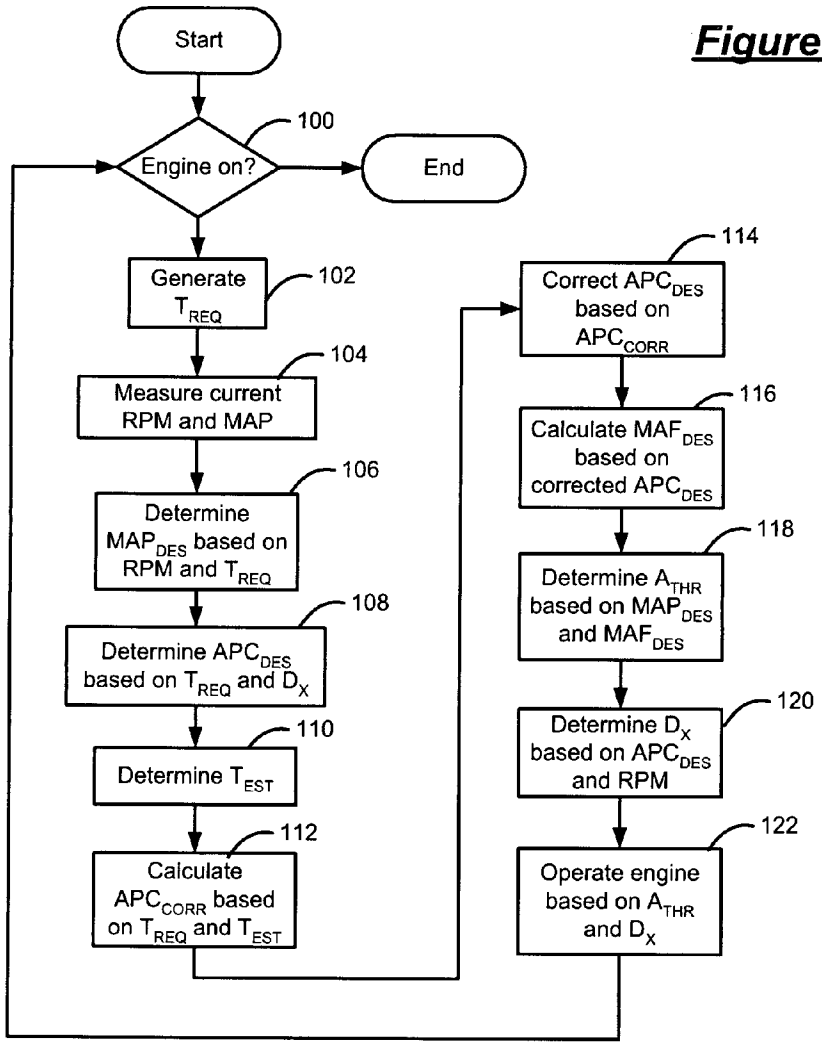
FIG. 2 is a flowchart illustrating steps executed by the coordinated torque control system of the present invention.

Referring now to FIG. 2, the engine torque control system will be discussed in further detail. In step 100, control determines whether the engine 12 is running. If the engine 12 is not running, control ends. If the engine 12 is running, control generates $T_{REQ}$ based on the operator input 43 in step 102. In step 104, control measures the current RPM and MAP. Control determines $MAP_{DES}$ based on $T_{REQ}$ and RPM in step 106. In step 108, control determines $APC_{DES}$ based on $T_{REQ}$ and $D_X$.

In step 110, control determines a torque estimate ($T_{EST}$). $T_{EST}$ is determined based on RPM, spark and a dilution estimate using a steady-state torque estimator, as discussed in detail in commonly assigned U.S. Pat. No. 6,704,638, issued Mar. 9, 2004, the disclosure of which is expressly incorporated herein by reference. In step 112, control calculates an air-per-cylinder correction ($APC_{CORR}$) based on $T_{REQ}$ and $T_{EST}$. Control corrects $APC_{DES}$ based on $APC_{CORR}$ in step 114. In step 116, control determines $MAF_{DES}$ based on the corrected $APC_{DES}$. $A_{THR}$ is determined based on $MAP_{DES}$ and $MAF_{DES}$ in step 118. In step 120, control determines $D_X$ (e.g., $D_{IPHSR}$, $D_{EPHSR}$, $D_{EGR}$, $D_{BPV}$ and $D_{IMTV}$) based on RPM and $APC_{DES}$. Control operates the engine based on $A_{THR}$ and $D_X$ in step 122 and loops back to step 100.

Figure 3:
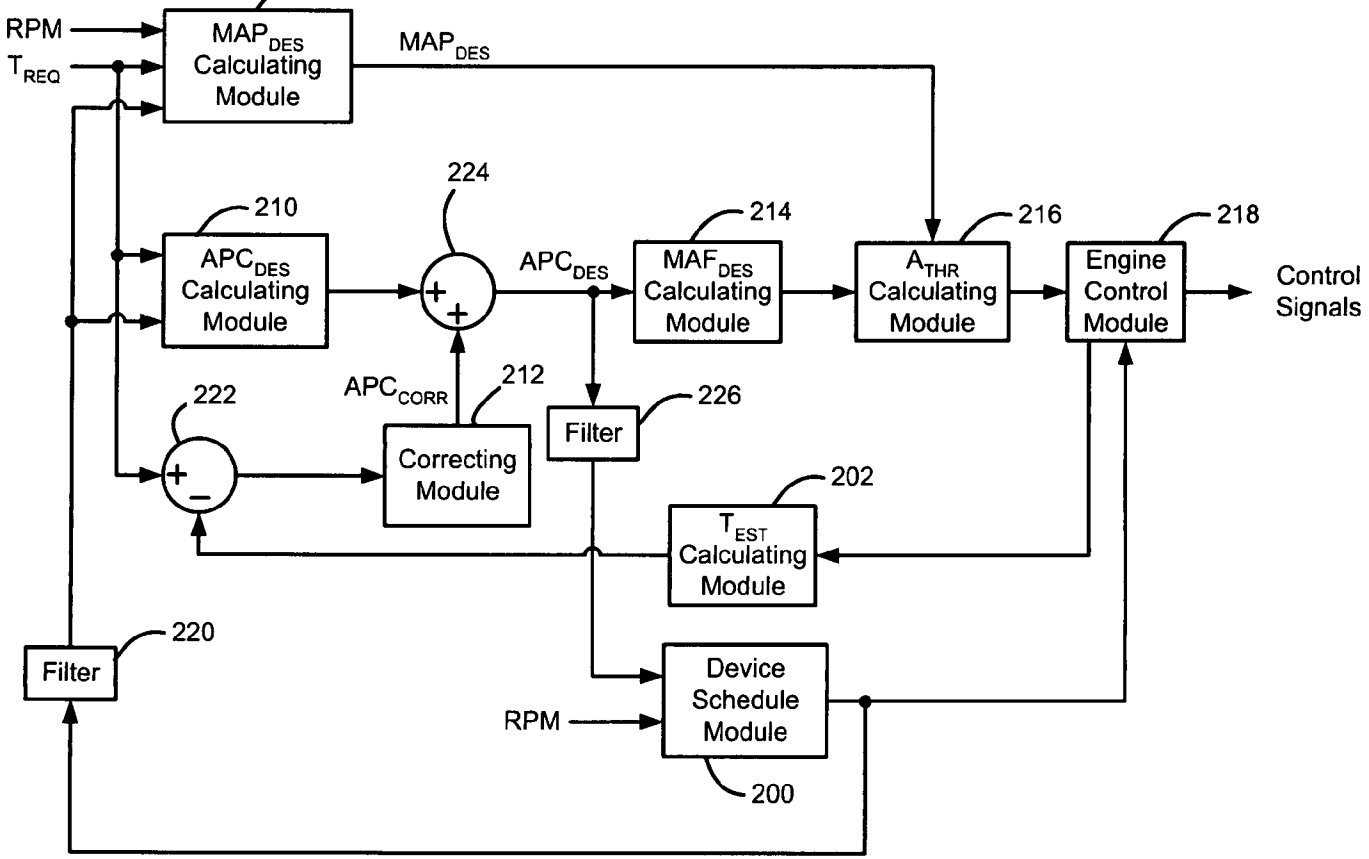
FIG. 3 is a block diagram illustrating modules that execute the coordinated torque control of the present invention.

Referring now to FIG. 3, exemplary modules will be discussed, which execute the coordinated torque control of the present invention. The modules include a device schedule module 200, a $T_{EST}$ calculating module 202, a $MAP_{DES}$ calculating module 204, an $APC_{DES}$ calculating module 210, a correcting module 212, a $MAF_{DES}$ calculating module 214, an $A_{THR}$ calculating module 216 and an engine control module 218.

The device schedule module 200 determines $D_X$ based on $APC_{DES}$ and RPM. $D_X$ is provided to the $MAP_{DES}$ calculating module 204 and the $APC_{DES}$ calculating module 210 through a filter 220 (e.g., low-pass filter). The $MAP_{DES}$ calculating module 204 calculates $MAP_{DES}$ based on $D_X$, RPM and $T_{REQ}$. $MAP_{DES}$ is provided to the $A_{THR}$ calculating module 216. The $APC_{DES}$ calculating module 210 calculates $APC_{DES}$ based on $T_{REQ}$ and $D_X$.

The $T_{EST}$ calculating module 202 calculates $T_{EST}$ and provides $T_{EST}$ to a summer 222. The summer 222 provides a difference between $T_{REQ}$ and $T_{EST}$, which is provided to the correcting module 212. $APC_{CORR}$ is determined by the correcting module 212 and is provided to a summer 224. The summer 224 provides the corrected $APC_{DES}$ based on the sum of $APC_{DES}$ and $APC_{CORR}$ and provides the corrected $APC_{DES}$ to the $MAF_{DES}$ calculating module 214 and to the device schedule module 200 through a filter 226 (e.g., low-pass filter).

The $MAF_{DES}$ calculating module 214 calculates $MAF_{DES}$ and based on the corrected $APC_{DES}$ and provides $MAF_{DES}$ to the $A_{THR}$ calculating module 216. $A_{THR}$ and $D_X$ are provided to the engine control module 218, which generates control signals based thereon. One control signal actuates the throttle to achieve $A_{THR}$ and another control signal or other control signals actuate the device or devices (e.g., the intake cam phaser 32, the exhaust cam phaser 34, the EGR system 36 and the intake manifold tuning valve 60) to achieve $T_{REQ}$.

Figure 4:
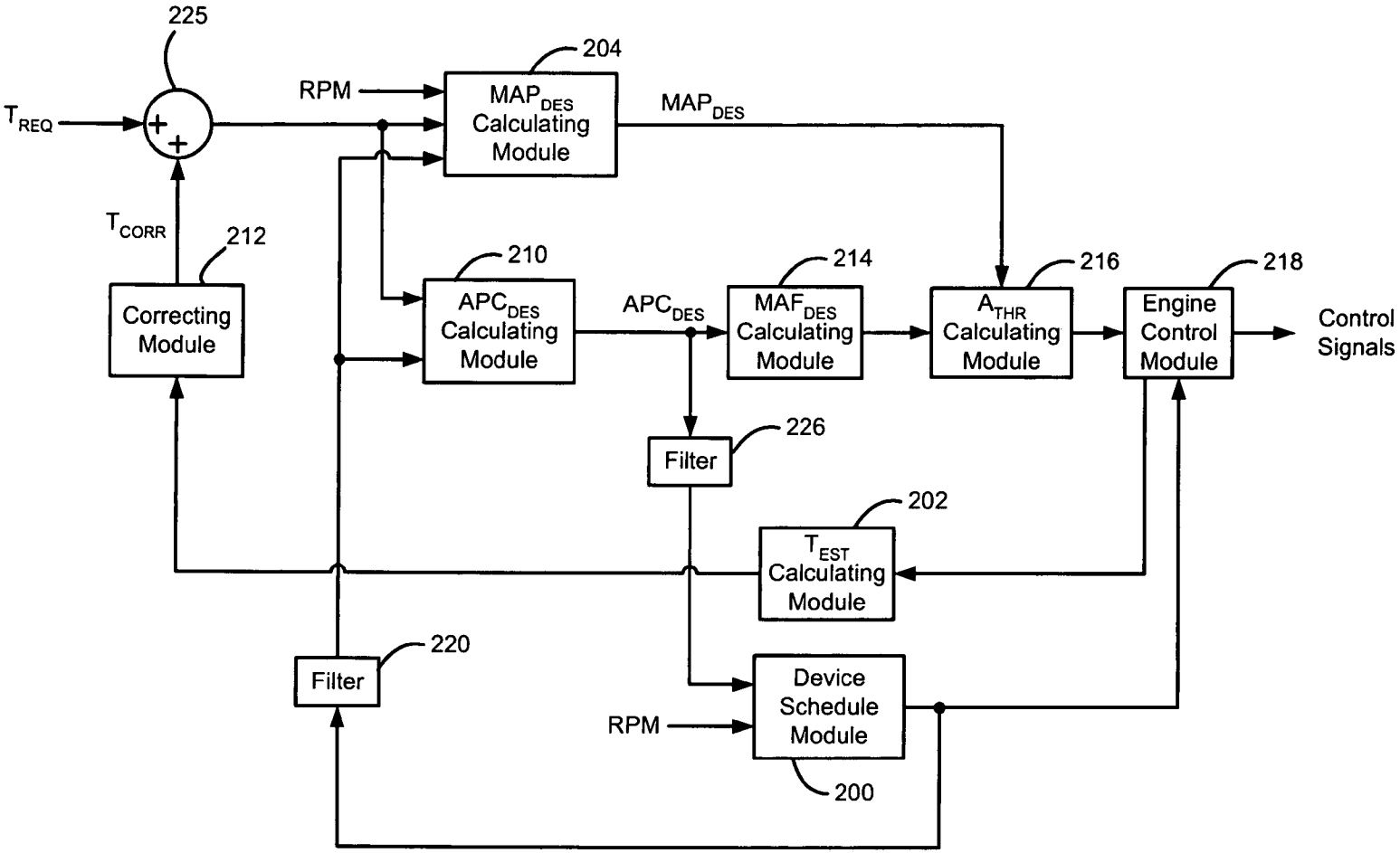
FIG. 4 is a block diagram illustrating an alternative arrangement of the modules of FIG. 3 that execute the coordinated torque control of the present invention.

Referring now to FIG. 4, an alternative configuration of the exemplary modules of FIG. 3 is illustrated. The alternative configuration corrects $T_{REQ}$ based on $T_{EST}$. More specifically, the correcting module 212 determines a torque correction factor ($T_{CORR}$) based on $T_{EST}$. A summer 225 provides a corrected $T_{REQ}$ based on $T_{REQ}$ and $T_{CORR}$. The corrected $T_{REQ}$ is provided to the $MAP_{DES}$ calculating module 204 and the $APC_{DES}$ calculating module 210. In this manner, $APC_{DES}$ from the $APC_{DES}$ calculating module is provided directly to the $MAF_{DES}$ calculating module 214 without correction. The remainder of the modules function as described above with respect to FIG. 3.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A torque control system for regulating operation of an engine, comprising:

a throttle that regulates air flow into said engine;

a device that regulates a torque output of said engine;

a first module that determines a throttle area based on a desired manifold absolute pressure (MAP) and a desired manifold air flow (MAF); and a second module that determines a device set-point based on a desired air per cylinder (APC) and an engine speed; and a third module that generates a throttle control signal to control said throttle based on said throttle area and that generates a device control signal to control said device based on said device set-point.

2. The torque control system of claim 1 wherein said device includes a cam phaser that regulates a phase angle of a cam shaft relative to a rotational position of said engine.

3. The torque control system of claim 2 wherein said cam shaft includes an intake cam shaft.

4. The torque control system of claim 2 wherein said cam shaft includes an exhaust cam shaft.

5. The torque control system of claim 1 wherein said device includes an exhaust gas recirculation (EGR) valve that regulates a flow of exhaust gas into an intake manifold of said engine.

6. The torque control system of claim 1 wherein said device includes an intake manifold valve that selectively partitions a volume of said intake manifold.

7. The torque control system of claim 1 wherein said device includes a turbo that provides compressed air to said engine.

8. The torque control system of claim 1 further comprising a fourth module that determines said desired MAP based on said engine speed and a torque request.

9. The torque control system of claim 1 further comprising a fourth module that determines said desired MAF based on said desired APC.

10. The torque control system of claim 1 further comprising a fourth module that determines said desired APC based on said torque request and a device schedule feedback signal.

11. The torque control system of claim 1 wherein said desired APC is corrected based on an APC correction factor.

12. The torque control system of claim 11 wherein said APC correction factor is determined based on a torque request and a torque estimate.

13. A method of regulating operation of an engine based on a coordinated torque control system, comprising:

determining a throttle area based on a desired manifold absolute pressure (MAP) and a desired manifold air flow (MAF);

determining a device set-point based on a desired air per cylinder (APC) and an engine speed;

generating a throttle control signal based on said throttle area;

generating a device control signal based on said device set-point;

regulating a throttle based on said throttle control signal to adjust air flow into said engine; and regulating a device based on said device control signal to adjust a torque output of said engine.

14. The method of claim 13 wherein said device includes a cam phaser that regulates a phase angle of a cam shaft relative to a rotational position of said engine.

15. The method of claim 14 wherein said cam shaft includes an intake cam shaft.

16. The method of claim 14 wherein said cam shaft includes an exhaust cam shaft.

17. The method of claim 13 wherein said device includes an exhaust gas recirculation (EGR) valve that regulates a flow of exhaust gas into an intake manifold of said engine.

18. The method of claim 13 wherein said device includes an intake manifold valve that selectively partitions a volume of said intake manifold.

19. The method of claim 13 wherein said device includes a turbo that provides compressed air to said engine.

20. The method of claim 13 further comprising determining said desired MAP based on said engine speed and a torque request.

21. The method of claim 13 further comprising determining said desired MAF based on said desired APC.

22. The method of claim 13 further comprising determining said desired APC based on said torque request and a device schedule feedback signal.

23. The method of claim 13 wherein said desired APC is corrected based on an APC correction factor.

24. The method of claim 23 wherein said APC correction factor is determined based on a torque request and a torque estimate.

25. A torque control system for regulating operation of an engine, comprising:

a throttle that regulates air flow into said engine;

a device that regulates a torque output of said engine; and a control module that determines a throttle area based on a desired manifold absolute pressure (MAP) and a desired manifold air flow (MAF), that determines a device set-point based on a desired air per cylinder (APC) and an engine speed, that generates a throttle control signal to control said throttle based on said throttle area and that generates a device control signal to control said device based on said device set-point.

26. The torque control system of claim 25 wherein said device includes a cam phaser that regulates a phase angle of a cam shaft relative to a rotational position of said engine.

27. The torque control system of claim 26 wherein said cam shaft includes an intake cam shaft.

28. The torque control system of claim 26 wherein said cam shaft includes an exhaust cam shaft.

29. The torque control system of claim 25 wherein said device includes an exhaust gas recirculation (EGR) valve that regulates a flow of exhaust gas into an intake manifold of said engine.

30. The torque control system of claim 25 wherein said device includes an intake manifold valve that selectively partitions a volume of said intake manifold.

31. The torque control system of claim 25 wherein said device includes a turbo that provides compressed air to said engine.

32. The torque control system of claim 25 wherein said control module determines said desired MAP based on said engine speed and a torque request.

33. The torque control system of claim 25 wherein said control module determines said desired MAF based on said desired APC.

34. The torque control system of claim 25 wherein said control module determines said desired APC based on said torque request and a device schedule feedback signal.

35. The torque control system of claim 25 wherein said desired APC is corrected based on an APC correction factor.

36. The torque control system of claim 35 wherein said APC correction factor is determined based on a torque request and a torque estimate.

37. A method of regulating operation of an engine based on a coordinated torque control system, comprising:

determining a throttle area based on a desired manifold absolute pressure (MAP) and a desired manifold air flow (MAF);

determining a cam phaser set-point based on a desired air per cylinder (APC) and an engine speed;

determining a device set-point based on a desired air per cylinder (APC) and an engine speed;

generating a throttle control signal based on said throttle area;

generating a cam phaser control signal based on said cam phaser set-point;

generating a device control signal based on said device set-point;

regulating a throttle based on said throttle control signal to adjust air flow into said engine regulating a cam phaser based on said cam phaser control signal to adjust a torque output of said engine; and regulating a device based on said device control signal to adjust a torque output of said engine.

38. The method of claim 37 wherein said cam phaser regulates a phase angle of a cam shaft relative to a rotational position of said engine.

39. The method of claim 38 wherein said cam shaft includes an intake cam shaft.

40. The method of claim 38 wherein said cam shaft includes an exhaust cam shaft.

41. The method of claim 37 wherein said device includes an exhaust gas recirculation (EGR) valve that regulates a flow of exhaust gas into an intake manifold of said engine.

42. The method of claim 37 wherein said device includes an intake manifold valve that selectively partitions a volume of said intake manifold.

43. The method of claim 37 wherein said device includes a turbo that provides compressed air to said engine.

44. The method of claim 37 further comprising determining said desired MAP based on said engine speed and a torque request.

45. The method of claim 37 further comprising determining said desired MAF based on said desired APC.

46. The method of claim 37 further comprising determining said desired APC based on said torque request and a device schedule feedback signal.

47. The method of claim 37 wherein said desired APC is corrected based on an APC correction factor.

48. The method of claim 47 wherein said APC correction factor is determined based on a torque request and a torque estimate.

* * * * *